US009107277B2

(12) United States Patent
Tanaka et al.

(10) Patent No.: US 9,107,277 B2
(45) Date of Patent: Aug. 11, 2015

(54) ELECTRONIC DEVICE AND CONTROL METHOD THEREFOR

(75) Inventors: Hiroki Tanaka, Tokyo (JP); Yukinori Shioya, Tokyo (JP); Michio Kobayashi, Tokyo (JP); Kenji Kanzaka, Tokyo (JP)

(73) Assignee: NEC DISPLAY SOLUTIONS, LTD., Tokyo (JP)

( * ) Notice: Subject to any disclaimer, the term of this patent is extended or adjusted under 35 U.S.C. 154(b) by 0 days.

(21) Appl. No.: 13/816,473

(22) PCT Filed: Sep. 10, 2010

(86) PCT No.: PCT/JP2010/065587

§ 371 (c)(1),
(2), (4) Date: Feb. 11, 2013

(87) PCT Pub. No.: WO2012/032647

PCT Pub. Date: Mar. 15, 2012

(65) Prior Publication Data

US 2013/0141005 A1 Jun. 6, 2013

(51) Int. Cl.

| | |
|---|---|
| ***H05B 41/39*** | (2006.01) |
| ***H05B 41/38*** | (2006.01) |
| ***H05B 41/392*** | (2006.01) |

(52) U.S. Cl.

CPC ..... *H05B 41/39* (2013.01); *H05B 41/382* (2013.01); *H05B 41/3921* (2013.01)

(58) Field of Classification Search

USPC ..... 315/291, 294, 297, 312

See application file for complete search history.

(56) References Cited

U.S. PATENT DOCUMENTS

| | | | | |
|---|---|---|---|---|
| 7,383,985 | B1 | 6/2008 | Aisa | |
| 2003/0080693 | A1 | 5/2003 | Ono et al. | |
| 2004/0000880 | A1 * | 1/2004 | Ozasa et al. | 315/291 |
| 2006/0017389 | A1 * | 1/2006 | Noh | 315/112 |
| 2009/0091272 | A1 | 4/2009 | Yamada et al. | |
| 2010/0033692 | A1 * | 2/2010 | Watanabe et al. | 353/85 |

FOREIGN PATENT DOCUMENTS

| | | | |
|---|---|---|---|
| CN | 1409885 | A | 4/2003 |
| JP | 2003-133091 | A | 5/2003 |
| JP | 2008-159469 | A | 7/2008 |
| JP | 2009-76419 | A | 4/2009 |

(Continued)

OTHER PUBLICATIONS

International Search Report dated Oct. 5, 2010 in PCT/JP2011/065587 with English translation thereof.

(Continued)

*Primary Examiner* — Douglas W Owens
*Assistant Examiner* — Jonathan Cooper
(74) *Attorney, Agent, or Firm* — McGinn IP Law Group, Pllc.

(57) ABSTRACT

In an electronic device including a discharge lamp, and a lamp power supply section that supplies power to the discharge lamp, a control section makes the lamp power supply section execute a lamp refresh process of supplying power necessary for generation of a halogen cycle to the discharge lamp at predetermined time intervals during low power operation in which the discharge lamp is lighted with power less than the rated power. Further, the control section records, in a recording section (non-volatile memory), a control instruction which is issued to the lamp power supply section during low power operation.

17 Claims, 4 Drawing Sheets

(56) References Cited

FOREIGN PATENT DOCUMENTS

| | | | |
|---|---|---|---|
| JP | 2009-93862 | A | 4/2009 |
| JP | 2009-231095 | A | 10/2009 |
| JP | 2010-500730 | A | 1/2010 |
| WO | WO 2008/020366 | | 2/2008 |

OTHER PUBLICATIONS

Chinese Office Action and Search Report dated Jan. 30, 2014, with English translation.

* cited by examiner

ELECTRONIC DEVICE AND CONTROL METHOD THEREFOR

TECHNICAL FIELD

The present invention relates to an electronic device provided with a discharge lamp, and relates to a control method of the electronic device.

BACKGROUND ART

In an electronic device, for example, a projection type display device, provided with a discharge lamp (hereinafter referred to simply as lamp), it is desired that the light quantity of the lamp can be freely increased or decreased (dimmed) according to the ambient brightness. When the light quantity of the lamp is reduced, the power consumption of the lamp is reduced, and the temperature rise in the housing including the lamp is also prevented. Therefore, the power consumed by cooling means, such as a fan, is also expected to be reduced. Usually, the dimming of a lamp is performed in the range of about 80 to 100% of the rated power of the lamp. When the light quantity of the lamp is to be further reduced, it is only necessary that the power supplied to the lamp is reduced below the power corresponding to the normal dimming range of the lamp.

However, when the lamp is lighted with power less than the rated power or less than the power corresponding to the normal dimming range of the lamp (hereinafter referred to as low power operation), the temperature in the bulb (light emitting tube) cannot be maintained at a temperature at which a halogen cycle occurs. This results in a problem that blackening of the bulb is caused and thereby the light quantity of the lamp is reduced.

When tungsten (W), which is usually used as an electrode material of the lamp, is energized, the tungsten is made incandescent at a high temperature, so as to be evaporated. The evaporated tungsten is moved near the inner wall surface of the bulb, temperature of inner wall surface being comparatively low. Near the inner wall surface of the bulb, the evaporated tungsten is combined with halogen (X) in the bulb, so that tungsten halide ($WX_2$) is formed. The vapor pressure of the tungsten halide is comparatively high, and hence the tungsten halide is circulated, in a gaseous state as is, in the bulb by convection. When the tungsten halide is heated in the vicinity of the electrode to a predetermined temperature (about 1400° C.) or higher, the tungsten halide is dissociated into halogen and tungsten. The tungsten resulting from the dissociation is returned to the electrode, and the halogen resulting from the dissociation repeats the same reactions as described above. A series of these chemical reactions is referred to as a halogen cycle. The blackening of the bulb means a state where black powder derived from the evaporated tungsten is stuck to the inner wall surface of the bulb.

In order to prevent the blackening due to the low power operation of the lamp, a lamp refresh process, in which power necessary for generating the halogen cycle is supplied to the lamp only during a predetermined time period at predetermined time intervals set beforehand by a lamp manufacturer, or the like, needs to be performed according to the operation power of the lamp. A method of refreshing a lamp is also described, for example, in Japanese Patent Laid-Open No. 2009-93862 (Patent Literature 1).

However, even in an electronic device which includes a lamp and which is configured to execute the lamp refresh process, there is a case where, when, after shipment of the electronic device, the low power operation of the electronic device is performed by a user, or the like, the blackening is caused in the lamp even though the lamp has not reached the end of its lifetime cycle. In this case, it is not easy to identify the cause of the blackening.

The lamp is used in the electronic device which includes a lamp power supply for stably supplying power to the lamp, and a control section for controlling the refresh operation of the lamp, and the like. Further, an operable temperature range is usually specified for the lamp. For this reason, when the blackening is caused in the lamp operated at a low power level, various causes, such as a failure of the lamp itself, a failure of the lamp power supply section, a control failure of the lamp refresh process, an unsuitable temperature control of the lamp, and an unsuitable installation environment of the electronic device, are considered as causes of the occurrence of blackening.

RELATED ART LITERATURE

Patent Literature

Patent Literature 1: Japanese Patent Laid-Open No. 2009-93862

SUMMARY

Therefore, an object of the present invention is to provide an electronic device configured to contribute to identifying a defective portion causing the blackening, and to provide a control method of the electronic device.

In order to achieve the above described object, the electronic device of an exemplary aspect of the present invention includes a discharge lamp, a lamp power supply section that supplies power to the discharge lamp, and a control section that makes the lamp power supply section execute a lamp refresh process of supplying power necessary for generation of a halogen cycle to the discharge lamp at predetermined time intervals during low power operation in which the discharge lamp is lighted with power less than the rated power. Further, the electronic device is configured such that the control section includes a recording section in which a control instruction is recorded, the control instruction being issued to the lamp power supply section during the low power operation.

On the other hand, the control method of an electronic device of an exemplary aspect of the present invention is a control method of controlling an electronic device including a discharge lamp and a lamp power supply section that supplies power to the discharge lamp. In the control method, a control section makes the lamp power supply section execute a lamp refresh process of supplying power necessary for generation of a halogen cycle to the discharge lamp at predetermined time intervals during low power operation in which the discharge lamp is lighted with power less than the rated power. Also, the control section records, in a recording section, a control instruction which is issued to the lamp power supply section during the low power operation.

EXEMPLARY EMBODIMENT

Next, the present invention will be described with reference to the accompanying drawings.

Figure 1:
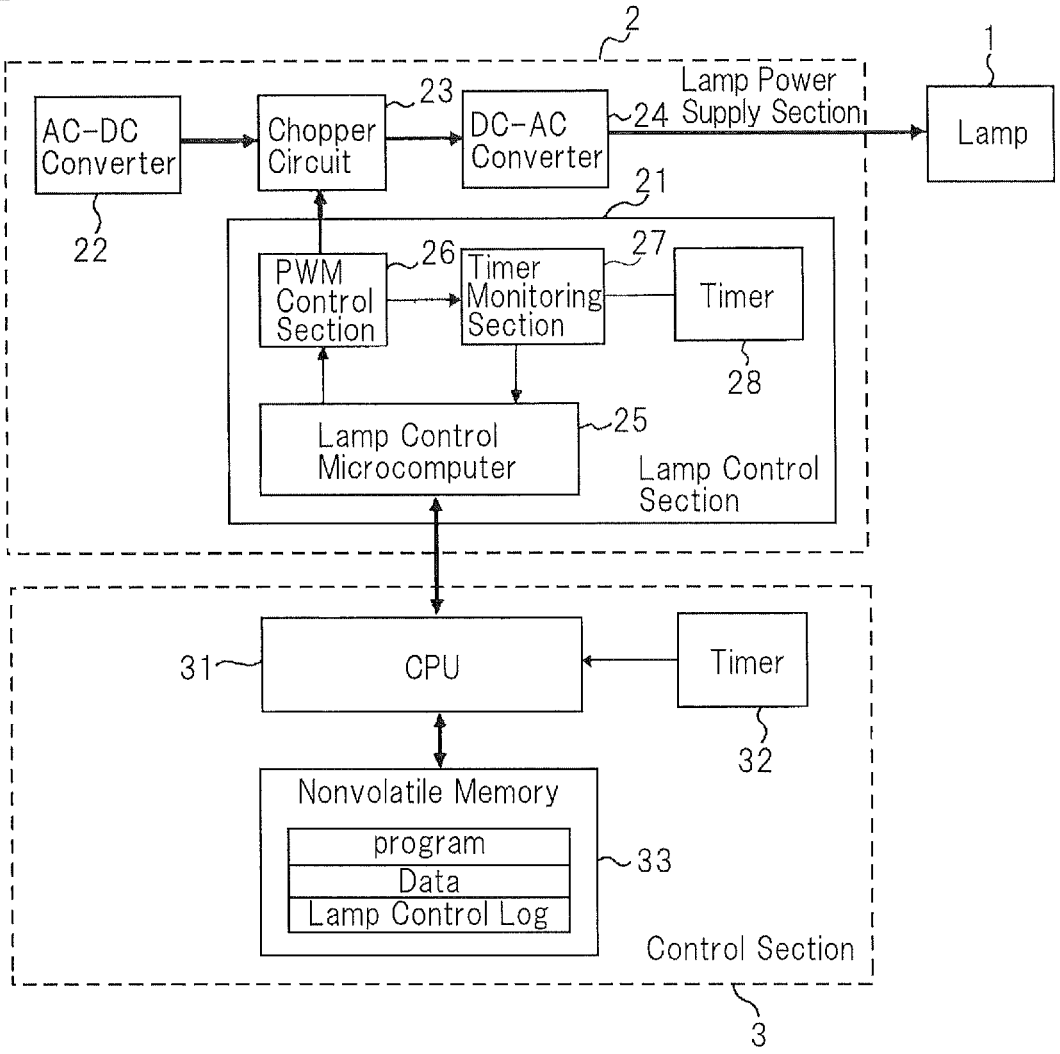
FIG. 1 is a block diagram showing a configuration example of an electronic device according to the present invention.

FIG. 1 is a block diagram showing a configuration example of an electronic device according to the present invention.

As shown in FIG. 1, the electronic device is configured by including lamp 1 (discharge lamp), lamp power supply section 2 that supplies necessary power to lamp 1, and control section 3 that controls operation of the whole electronic device including lamp 1 and lamp power supply section 2. As lamp 1, for example, an ultra-high pressure mercury lamp is used.

Lamp power supply section 2 includes lamp control section 21, AC-DC converter 22, chopper circuit 23, and DC-AC converter 24.

AC-DC converter 22 converts, into a DC voltage, an AC voltage (commercial AC voltage) supplied from the outside.

According to an instruction of lamp control section 21, chopper circuit 23 lowers the DC voltage outputted from AC-DC converter 22 by switching the DC voltage.

DC-AC converter 24 converts, into an AC voltage, the DC voltage outputted from chopper circuit 23, and supplies the AC voltage to lamp 1.

Lamp control section 21 includes lamp control microcomputer 25, PWM (Pulse Width Modulation) control section 26, timer monitoring section 27, and timer 28. According to a program stored in lamp control microcomputer 25, lamp control microcomputer 25 operates PWM control section 26 so that the DC voltage outputted from chopper circuit 23 is controlled to become a required value. Further, when detecting a refresh error described below, lamp control microcomputer 25 notifies the occurrence of the refresh error to control section 3 by using timer 28 and timer monitoring section 27.

Control section 3 includes CPU (Central Processing Unit) 31, timer 32, and nonvolatile memory 33, and controls operation of the whole electronic device including lamp power supply section 2 by CPU 31 according to a program stored in nonvolatile memory 33. Various data processed by CPU 31 are stored in nonvolatile memory 33 along with the program.

In addition to the area in which the program and data are stored, the electronic device of the exemplary embodiment includes, in nonvolatile memory 33 provided in control section 3, a lamp control log area in which control instructions issued to lamp power supply section 2 are stored. In other words, control section 3 includes an area (recording section) in which control instructions issued to lamp power supply section 2 are recorded.

The information recorded in the lamp control log area includes the number of times of the low power operation of lamp 1, the total time of the low power operation, the number of times of execution of the lamp refresh process of lamp 1, the total execution time of the lamp refresh process, and the like. The total time of the low power operation of lamp 1 (hereinafter referred to as total low power operation time), and the total execution time of the lamp refresh process (hereinafter referred to as total refresh execution time) can be measured by using timer 32 provided in control section 3. Further, the number of times of the low power operation of lamp 1 (hereinafter referred to as the number of low power operation times), and the number of times of execution of the lamp refresh process (hereinafter referred to as the number of refresh execution times) can be counted by using a counter, a register (both not shown), and the like, provided in control section 3.

Further, in the electronic device of the exemplary embodiment, in the case where, even when the lamp refresh process needs to be executed, an instruction for execution of the lamp refresh process is not issued to lamp control section 21 from control section 3, lamp control section 21 (lamp control microcomputer 25) issues a request of forcible execution of the lamp refresh process to control section 3. In the following, the state, in which, even when the lamp refresh process needs to be executed, the instruction for execution of the lamp refresh process is not issued from control section 3 to lamp control section 21, is referred to as "refresh error". When detecting a refresh error, lamp control section 21 requires forcible execution of the lamp refresh process by notifying the occurrence of the refresh error to control section 3. Control section 3 also records the number of times of notification of the refresh error in the lamp control log area. The number of times of refresh error notification can be counted by using a counter, a register (both not shown), and the like, similarly to the number of low power operation times of lamp 1 and the number of refresh execution times.

Note that the information recorded in the lamp control log area is not limited to the total low power operation time, the number of low power operation times, the total refresh execution time, the number of refresh execution times, and the number of times of refresh error notification, as described above. The other kinds of information may be recorded in the lamp control log area according to the specification of the electronic device, and the environment in which the electronic device is expected to be installed, and the like.

Next, the operation of the electronic device of the exemplary embodiment will be described with reference to FIG. 2 to FIG. 4.

Figure 2:
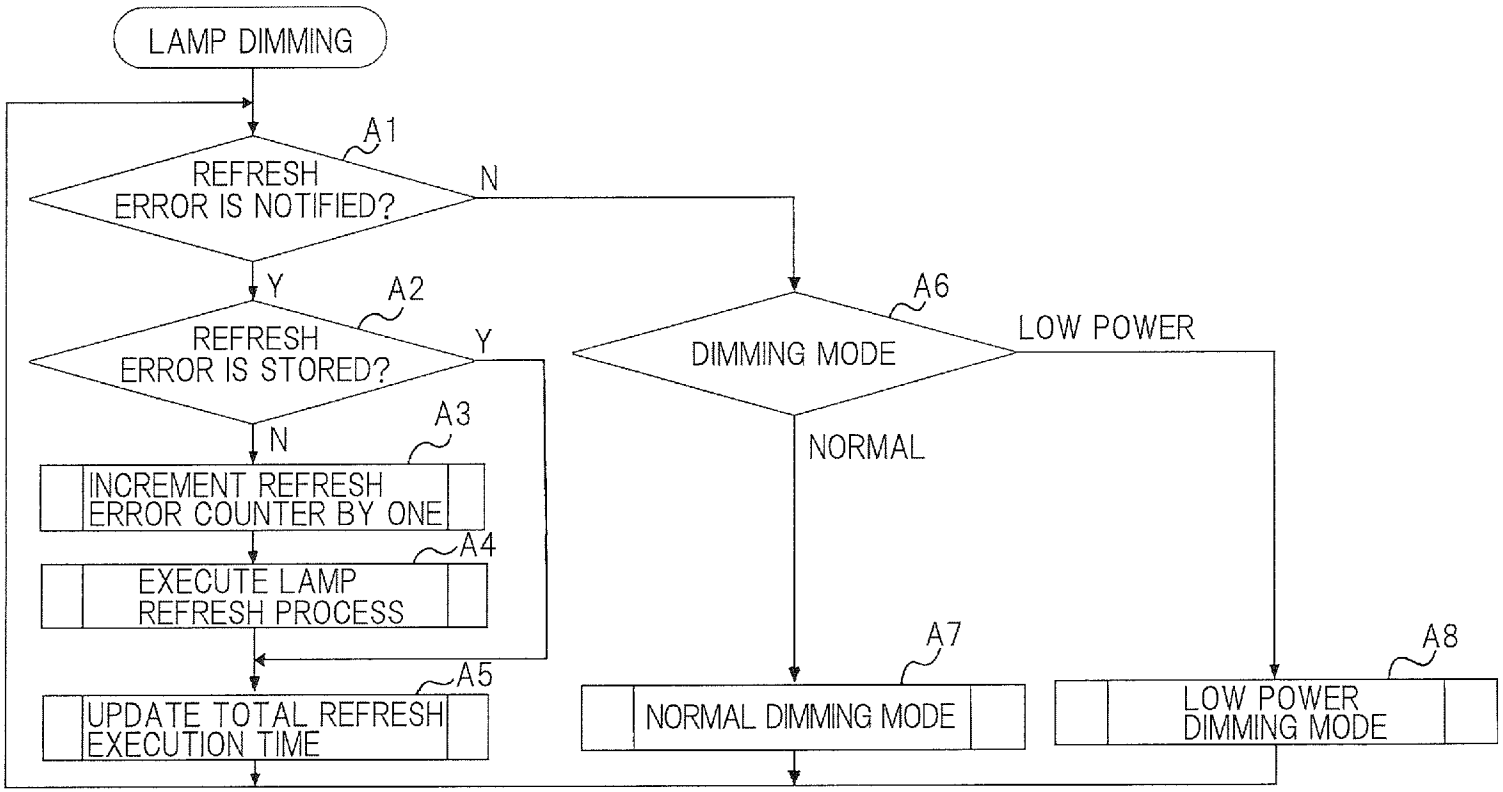
FIG. 2 is a flow chart showing a processing procedure of the control section at the time of dimming the lamp.

FIG. 2 is a flow chart showing a processing procedure of the control section at the time of dimming the lamp.

As shown in FIG. 2, when lamp 1 is dimmed, control section 3 first determines whether or not the refresh error is notified from lamp control section 2 (step A1). When the refresh error is notified, control section 3 determines whether or not the notified refresh error is stored in the lamp control log area (step A2). When the refresh error is not stored, control section 3 increments, by "one", the value of a counter (refresh error counter) for counting the number of times of refresh error notification (step A3), and makes lamp power supply section 2 execute a predetermined lamp refresh process (step A4). Then, control section 3 updates the value of the total refresh execution time stored in the lamp control log area, in correspondence with the refresh execution time instructed from control section 3 to lamp power supply section 2 in step A4 (step A5).

When the refresh error is already stored in the process in step A2, control section 3 shifts to the process in step A5, and updates the value of the total refresh execution time stored in the lamp control log area, to correspond with the time during which lamp power supply section 2 is made to execute the lamp refresh process at the time of notification of the refresh error.

When the refresh error is not notified in the process of step A1, control section 3 determines whether the dimming mode is the normal dimming mode or the low power dimming mode (step A6). The dimming mode is set by the user by using, for example, an input/output interface (not shown). The normal dimming mode is a mode in which lamp 1 is operated at about 80% to 100% of the rated power. In the normal dimming mode, a halogen cycle occurs, and hence lamp 1 is stably operated. The low power dimming mode is a mode in which lamp 1 is operated at a power level lower than the power level of the normal dimming mode.

When the dimming mode is set to the normal dimming mode, control section 3 lights lamp 1 in a range of the normal dimming mode, which range corresponds to a light quantity specified by the user, or the like, by using, for example, the input/output interface (not shown) (step A7). Further, when the dimming mode is set to the low power dimming mode, control section 3 lights lamp 1 in the range of the low power dimming mode, which range corresponds to a light quantity specified by the user, or the like, by using, for example, the input/output interface (not shown) (step A8).

Next, a processing procedure of control section 3 at the time when the dimming mode is set to the low power dimming mode shown in FIG. 2 will be described with reference to FIG. 3.

Figure 3:
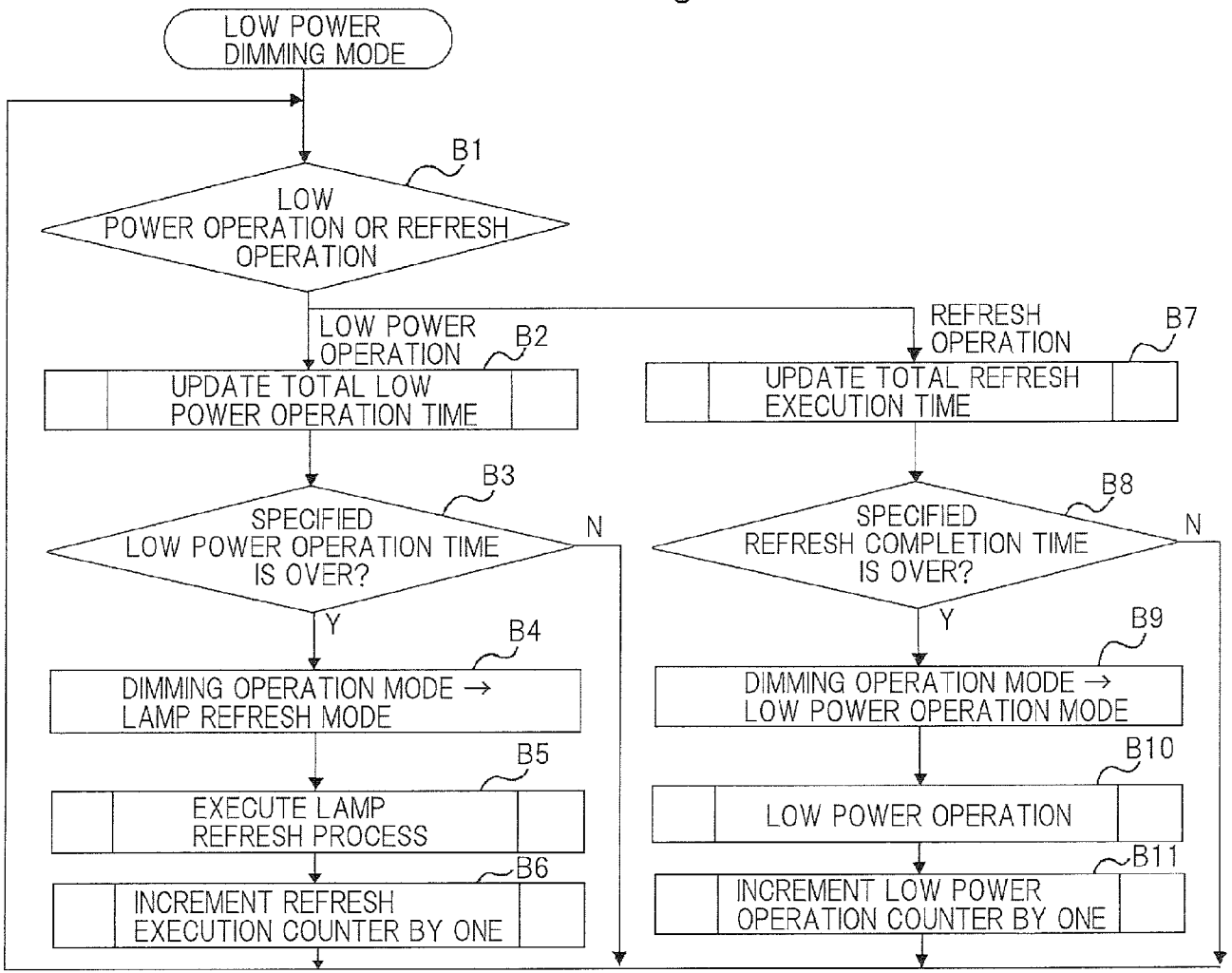
FIG. 3 is a flow chart showing a processing procedure of the control section at the time of a low power dimming mode.

FIG. 3 is a flow chart showing a processing procedure of the control section at the time when the lamp is in the low power dimming mode. FIG. 3 shows a processing procedure in which, in the low power dimming mode, control section 3 operates lamp 1 at a low power level and performs, as required, switching between the low power dimming mode and the lamp refresh mode.

As shown in FIG. 3, at the time when the lamp is in the low power dimming mode, control section 3 first determines whether or not lamp 1 is operated in the low power operation mode or in the refresh operation mode (step B1). When lamp 1 is operated in the low power operation mode, control section 3 updates the value of the total low power operation time stored in the lamp control log area according to the current low power operation time (step B2).

Subsequently, control section 3 determines whether or not the current low power operation time exceeds specified low power operation time set beforehand (step B3). The specified low power operation time is a permissible time which is set beforehand in correspondence with the specification and operation power of lamp 1 and during which lamp 1 can be continuously operated at low power. When the current low power operation time of lamp 1 does not exceed the specified low power operation time, control section 3 repeats the processing from step B1.

When the current low power operation time of lamp 1 exceeds the specified low power operation time, control section 3 determines that the lamp refresh process needs to be executed. Thereby, control section 3 switches the dimming operation mode to the lamp refresh mode (step B4), and makes lamp power supply section 2 execute the predetermined lamp refresh process (step B5). Then, control section 3 increments, by "one", the value of the refresh execution counter which value indicates the number of refresh execution times (step B6).

When determining in the processing in step B1 that refresh process is being executed, control section 3 updates the value of the total refresh execution time stored in the lamp control log area according to the current lamp refresh execution time (step B7).

Subsequently, control section 3 determines whether or not the current lamp refresh execution time exceeds specified refresh completion time (step B8). The specified refresh completion time is refresh execution time which is set beforehand according to the specification and operation power of lamp 1 and which is required to complete one cycle of the lamp refresh process. When the current lamp refresh execution time does not exceed the specified refresh completion time, control section 3 repeats the processing from step B1.

When the current lamp refresh execution time exceeds the specified refresh completion time, control section 3 determines that the low power operation of lamp 1 can be performed. Thereby, control section 3 switches the dimming operation mode to the low power operation mode (step B9), and performs the required low power operation (step B10). Then, control section 3 increments, by "one", the value of the low power operation counter, which value indicates the number of low power operation times of lamp 1 (step B11).

Next, a processing procedure of the lamp control section at the time of low power dimming mode shown in FIG. 3 will be described with reference to FIG. 4.

Figure 4:
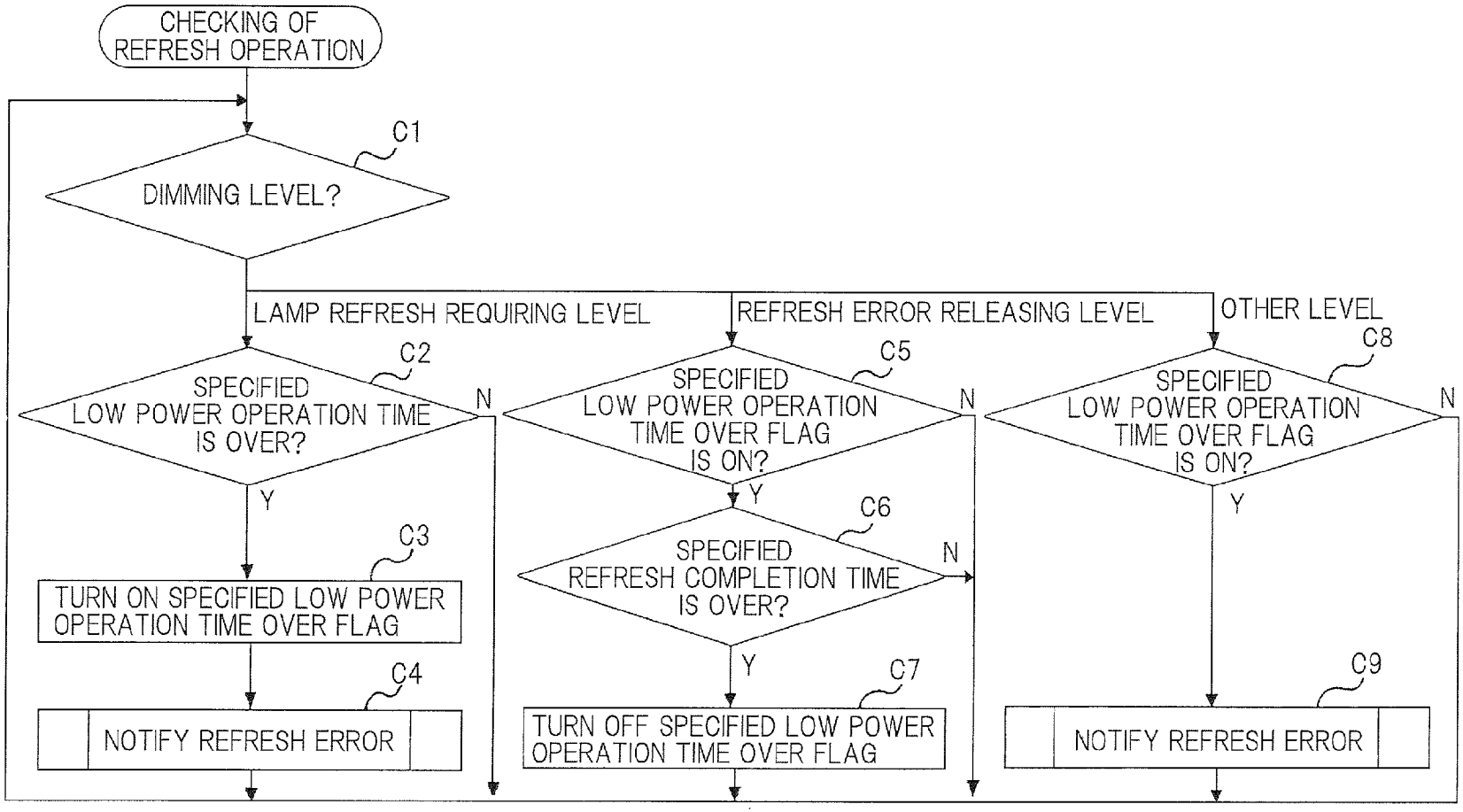
FIG. 4 is a flow chart showing a processing procedure of the lamp control section shown in FIG. 1.

FIG. 4 is a flow chart showing a processing procedure of the lamp control section shown in FIG. 1. FIG. 4 shows a processing procedure for notifying a refresh error to control section 3 from lamp control section 21 at the time when control section 3 does not instruct that the lamp refresh process be executed during the low power operation of lamp 1.

As shown in FIG. 4, when receiving, from control section 3, an instruction value indicating the dimming level of the lamp, lamp control section 21 determines which level from among a lamp refresh requiring level, a refresh error releasing level, and the other level corresponds to the instruction value (step C1). The lamp refresh requiring level indicates an instruction value which is received from control section 3 and requires execution of the lamp refresh process, that is, an instruction value on the basis of which lamp 1 is operated at low power. The refresh error releasing level indicates an instruction value which is received from control section 3 and enables the refresh error to be released, that is, an instruction value on the basis of which the lamp refresh process is executed. The other level indicates an instruction value which is received from control section 3 and is neither the lamp refresh requiring level nor the refresh error releasing level, (for example, an instruction value which is lower than the normal dimming range, and on the basis of which lamp 1 is operated at a power level different from the power level during execution of the lamp refresh process).

When the instruction value from control section 3 is the lamp refresh requiring level, lamp control section 21 determines whether or not the current low power operation time exceeds the specified low power operation time set beforehand (step C2).

When the current low power operation time does not exceed the specified low power operation time, lamp control section 21 repeats the processing from step C1. When the current low power operation time exceeds the specified low power operation time, lamp control section 21 sets, to ON, a specified low power operation time over flag provided beforehand (step C3). Then, lamp control section 21 notifies the refresh error to control section 3 (step C4), and repeats the processing from step C1.

When the instruction value from control section 3 is the refresh error releasing level, lamp control section 21 determines whether or not the specified low power operation time over flag is set to ON (step C5). When the specified low power operation time over flag is not set to ON, lamp control section 21 repeats the processing from step C1. When the specified low power operation time over flag is set to ON, lamp control section 21 determines whether or not the current lamp refresh execution time exceeds the specified refresh completion time (step C6). When the current lamp refresh execution time does not exceed the specified refresh completion time, lamp control section 21 repeats the processing from step C1. When the current lamp refresh execution time exceeds the specified refresh completion time, lamp control section 21 sets to OFF the specified low power operation time over flag (step C7), and repeats the processing from step C1.

When the instruction value from control section 3 is the other level, lamp control section 21 determines whether or not the specified low power operation time over flag is set to ON (step C8). When the specified low power operation time over flag is not set to ON, lamp control section 21 repeats the processing from step C1. When the specified low power operation time over flag is set to ON, lamp control section 21 notifies the refresh error to control section 3 (step C9), and repeats the processing from step C1.

In the electronic device of the exemplary embodiment, when the processes shown in FIG. 2 to FIG. 4 are performed, the total low power operation time, the number of low power operation times, the number of refresh execution times, the total refresh execution time, and the number of times of refresh error notification are obtained for lamp 1 and recorded in the lamp control log area of nonvolatile memory 33 provided in control section 3.

Therefore, in the case where blackening occurs in a lamp by low power operation after shipment, when, for example, the number of times of refresh error notification is recorded in the lamp control log area of nonvolatile memory 33, it is possible to determine that control section 3 has not normally instructed execution of the lamp refresh process, that is, it is possible to determine that the blackening is due to a control failure of the lamp refresh process by control section 3.

Further, when the number of times of refresh error notification is not recorded in the lamp control log area of nonvolatile memory 33, and when the value of "total low power operation time/the number of low power operation times" is within the specified low power operation time set beforehand according to the specification and operation power of lamp 1, and when the value of "total refresh execution time/the number of refresh execution times" satisfies the specified refresh completion time set beforehand according to the specification and operation power of lamp 1, it is possible to determine that blackening is due to a failure of lamp 1 or a failure of lamp power supply section 2, or due to an unsuitable temperature control of the lamp or an unsuitable installation environment of the electronic device.

In the electronic device of the exemplary embodiment, the control instruction issued to lamp power supply section 2 at the time of low power operation is recorded in the lamp control log area (recording section) of nonvolatile memory 33. Thereby, even when blackening is caused in lamp 1 by low power operation after shipment, the defective portion causing the blackening can be limited to a comparatively narrow range by analyzing the information recorded in the lamp control log area (recording section). Therefore, it is possible to obtain an electronic device which can contribute to identifying a defective portion causing the blackening.

In the above, the present invention has been described with reference to the exemplary embodiment, but the present invention is not limited to the exemplary embodiment. A configuration and details of the present invention may be modified in various ways within the scope of the present invention in a manner that a person skilled in the art can understand.

The invention claimed is:

1. An electronic device, comprising a discharge lamp;

a lamp power supply section that supplies power to said discharge lamp; and a control section that makes said lamp power supply section execute a lamp refresh process of supplying power necessary for generation of a halogen cycle to said discharge lamp at predetermined time intervals during a low power operation in which said discharge lamp is lighted with power less than a rated power, wherein said control section includes:

a recording section in which a control instruction is recorded, the control instruction being issued to said lamp power supply section during the low power operation; and a timer that is configured to measure a total low power operation time of said discharge lamp and a total lamp refresh execution time.

2. The electronic device according to claim 1, wherein, in a case where, when the lamp refresh process needs to be executed, said lamp power supply section detects a refresh error indicating that an execution of the lamp refresh process is not instructed from said control section, said lamp power supply section notifies an occurrence of the refresh error to said control section, and wherein said control section records, in said recording section, a number of times of the low power operation of said discharge lamp, the total low power operation time of said discharge lamp, a number of times of the lamp refresh execution, the total lamp refresh execution time, and a number of times of the refresh error notification from said lamp power supply section.

3. A control method of an electronic device, including:

a discharge lamp; and a lamp power supply section that supplies power to said discharge lamp, wherein a control section makes said lamp power supply section execute a lamp refresh process of supplying power necessary for generation of a halogen cycle to said discharge lamp at predetermined time intervals during a low power operation in which said discharge lamp is lighted with power less than a rated power, and records, in a recording section, a control instruction which is issued to said lamp power supply section during the low power operation, and wherein said method comprises:

measuring, in a timer of said control section, a total low power operation time of said discharge lamp and a total lamp refresh execution time.

4. The control method of the electronic device according to claim 3, wherein, in a case where, when the lamp refresh process needs to be executed, said lamp power supply section detects a refresh error indicating that said control section has not issued instructions to execute the lamp refresh process, said lamp power supply section notifies an occurrence of the refresh error to said control section, and wherein said control section records, in said recording section, a number of times of the low power operation of said discharge lamp, the total low power operation time of said discharge lamp, a number of times of the lamp refresh execution the total lamp refresh execution time, and a number of times of the refresh error notification from said lamp power supply section.

5. The electronic device according to claim 2, wherein said control section further comprises:

a counter that counts the number of times that the low power operation is executed and the number of times that the lamp refresh execution is executed.

6. The electronic device according to claim 2, wherein said lamp power supply section determines whether or not a current operation time during said low power operation exceeds a specified operation time set beforehand, and requires an execution of said lamp refresh process by notifying the occurrence of said refresh error to said control section when said current operation time exceeds said specified operation time.

7. The electronic device according to claim 1, wherein, when the lamp refresh process needs to be executed, said lamp power supply section is configured to detect a refresh error indicating that an execution of the lamp refresh process is not instructed from said control section, said lamp power supply section notifying an occurrence of the refresh error to said control section, and wherein said recording section is configured to record a number of times of the low power operation of said discharge lamp, the total low power operation time of said discharge lamp, a number of times of the lamp refresh execution, the total lamp refresh execution time, and a number of times of the refresh error notification from said lamp power supply section.

8. The electronic device according to claim 7, wherein said control section further comprises:

a counter that is configured to count the number of times that the low power operation is executed and the number of times that the lamp refresh execution is executed.

9. The electronic device according to claim 1, wherein said lamp power supply section is configured to determine whether a current operation time during said low power operation exceeds a specified operation time set beforehand.

10. The electronic device according to claim 9, wherein said lamp power supply section further is configured to require an execution of said lamp refresh process by notifying an occurrence of a refresh error, indicating that an execution of the lamp refresh process is not instructed from said control section, to said control section when said current operation time exceeds said specified operation time.

11. The electronic device according to claim 10, further comprising:

a lamp control section comprising another timer and a timer monitoring section, wherein the lamp control section is configured to notify the occurrence of the refresh error to the control section using said another timer and the timer monitoring section.

12. The electronic device according to claim 1, further comprising:

a timer monitoring section, wherein the lamp control section is configured to notify an occurrence of a refresh error, indicating that an execution of the lamp refresh process is not instructed from said control section, to the control section using the timer and the timer monitoring section.

13. The control method of the electronic device according to claim 4, wherein said control section counts the number of times that the low power operation is executed and the number of times that the lamp refresh execution is executed.

14. The control method of the electronic device according to claim 4, wherein said lamp power supply section determines whether or not a current operation time during said low power operation exceeds a specified operation time set beforehand, and requires an execution of said lamp refresh process by notifying the occurrence of said refresh error to said control section when said current operation time exceeds said specified operation time.

15. The control method of the electronic device according to claim 3, wherein, in a case that the lamp refresh process needs to be executed, said lamp power supply section detects a refresh error indicating that an execution of the lamp refresh process is not instructed from said control section, said lamp power supply section notifying an occurrence of the refresh error to said control section.

16. The control method of the electronic device according to claim 15, wherein said method further comprises:

recording a number of times of the low power operation of said discharge lamp, the total low power operation time of said discharge lamp, a number of times of the lamp refresh execution, the total lamp refresh execution time, and a number of times of the refresh error notification from said lamp power supply section.

17. The control method of the electronic device according to claim 16, wherein said method further comprises:

counting, in a counter of said control section, the number of times that the low power operation is executed and the number of times that the lamp refresh execution is executed; and notifying the occurrence of the refresh error to the control section using another timer and a timer monitoring section, said electric device further comprising a lamp control section that comprises said another timer and the timer monitoring section.

* * * * *